United States Patent [19]

Calato et al.

[11] 4,048,896

[45] Sept. 20, 1977

[54] DRUM BEATER

[76] Inventors: Joseph D. Calato, 8685 Rivershore Drive, Niagara Falls, N.Y. 14304; Joseph S. Calato, 2750 Dickersonville Road, Niagara Falls, N.Y. 14131

[21] Appl. No.: 644,419

[22] Filed: Dec. 24, 1975

[51] Int. Cl.[2] ..... G10D 13/00

[52] U.S. Cl. ..... 84/422 R

[58] Field of Search ..... 84/422

[56] References Cited

U.S. PATENT DOCUMENTS

| | | | |
|---|---|---|---|
| 2,551,635 | 5/1951 | Ramsey | 84/422 |
| 3,618,441 | 11/1971 | Fearns | 84/422 R |

FOREIGN PATENT DOCUMENTS

| | | | |
|---|---|---|---|
| 1,262,113 | 2/1968 | Germany | 84/422 R |

*Primary Examiner*—Lawrence R. Franklin
*Attorney, Agent, or Firm*—Ashlan F. Harlan, Jr.

[57] ABSTRACT

A drum beater, operated by a foot pedal which is easily and conveniently attached to a drum, provides adjustments for the length of the beater stem and for the length of the beater ball stroke. Means, comprising a pair of opposed, adjustable, tension springs for resisting movement of the beater ball toward the drum head and for controlling the rebound of the beater ball after it has struck the drum head.

9 Claims, 6 Drawing Figures

Fig. 3.
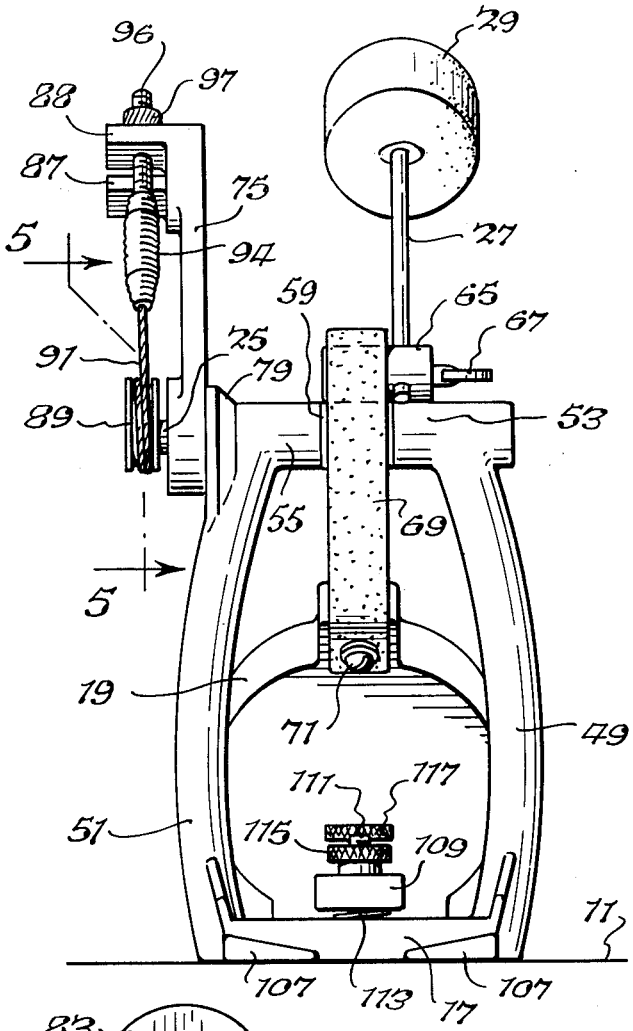
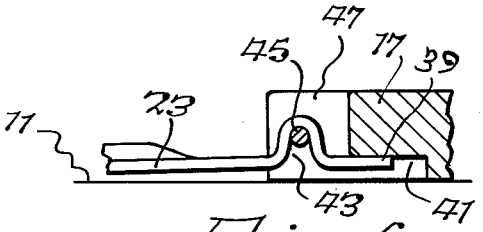
Fig. 6.
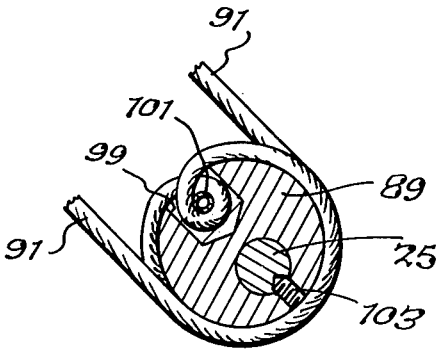
Fig. 5.
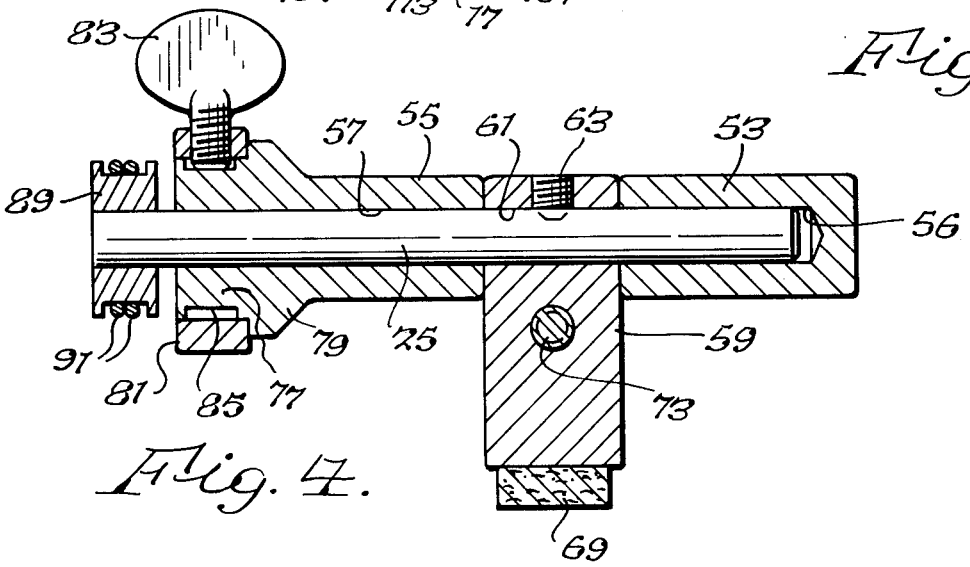
Fig. 4.

DRUM BEATER

BACKGROUND OF THE INVENTION

The invention of the present application relates to drum beaters and is particularly concerned with a novel drum beater construction which provides improved action thereof.

Drum beaters are used by drummers in musical ensembles where the percussion instruments are stationary and arranged about the drummer. Thereby the drummer or percussionist is enabled to strike a bass drum by movement on his or her foot on a pedal while the drummer's hands are engaged with other instruments. Many such devices have been the subjects of numerous letters patents. Typical of these are U.S. Pat. Nos. 1,551,635; 3,030,847; and 3,439,574. Prior art drum beaters are commonly provided with means for clamping them on the rim of a bass drum, with means for adjusting the length of the beater stroke and with spring means for resisting movement of the foot pedal and the beater ball. However, in many prior art drum beaters adequate means for adjustment is lacking and the drummer is unable to perform with the freedom and ease which is desirable.

It is, therefore, an object of the present invention to provide a drum beater of simple construction which is capable of easy and full adjustment with respect to beater stroke length, the point of impact on the drum, and the resilient loading of the device to resist movement of the beater ball toward the drum head and rebound of the beater ball from said head.

SUMMARY OF THE INVENTION

The drum beater of the present invention is readily and quickly attached to the rim or hoop of a bass drum and provides a beater ball or head which is actuated by a treadle or foot pedal so as to strike the drum head. Adjustments are provided for the length of the beater stem and for the length of the stroke of the beater ball. There are also provided means for quickly mounting and dismounting the foot pedal so the device can be conveniently carried and means, comprising a pair of opposed tension springs, for resisting movement of the beater ball toward the drum head and for controlling rebound of the beater head or ball after it has struck the drum head. These springs are adjustable to vary the action.

SHORT DESCRIPTION OF THE DRAWINGS

FIG. 3 is an end view of the drum beater illustrated in FIGS. 1 and 2;

FIG. 4 is an enlarged, sectional detail view taken on line 4—4 of FIG. 1;

FIG. 5 is a sectional detail view taken on line 5—5 of FIG. 3; and

FIG. 6 is a fragmentry detail view which shows the means for retaining the foot pedal in position.

DESCRIPTION OF THE INVENTION

Figure 1:
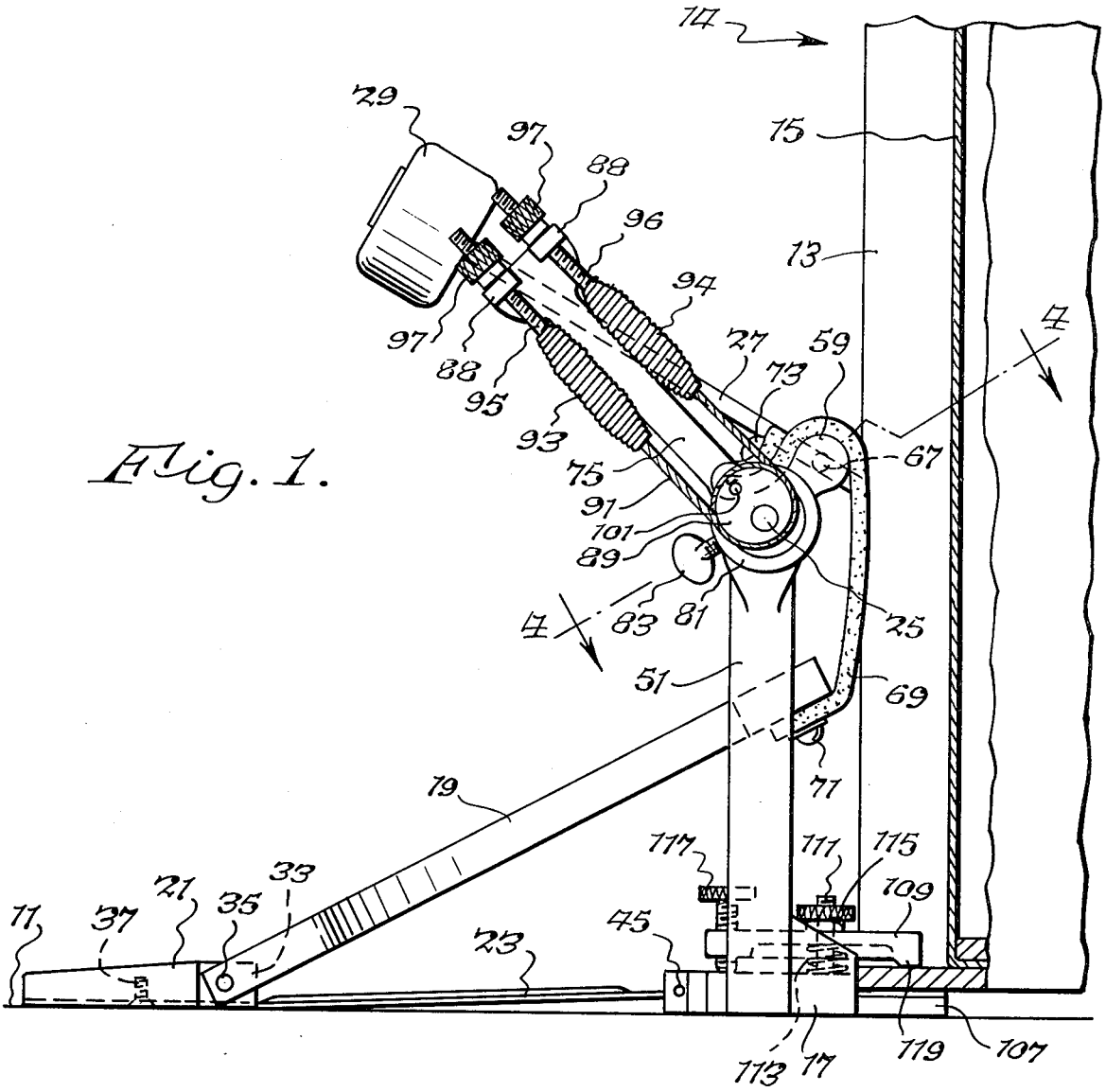
FIG. 1 is a side elevational view of the drum beater of the present invention, shown with a portion of the bass drum on which it is mounted.

The terms "upper", "lower", "top", "bottom", "right", "left", "above", "below", "vertical", and "horizontal", and similar terms of position and/or direction as used hereinafter refer to the illustrations in the drawings, but are used only for convenience in description and/or reference. Such terms should not be so construed as to imply a necessary positioning of the structure or portions thereof, or to limit the scope of this invention.

In FIG. 1, an embodiment of the novel drum beater of the present invention is shown resting on a floor or other surface 11 and clamped, by mechanism hereinafter described, to the rim or hoop 13 of a bass drum 14 having a drum head 15. It should be understood that the drum 14 does not constitute a part of the present invention and may be of any desired material and construction, and it should be further understood that the drum beater of the present invention may be used in conjunction with a wide variety of commercially available bass drums.

The drum beater comprises a base constituted by the plate 17; drum-clamping mechanism carried by said base, a treadle or foot pedal 19; a heel plate 21 on which one end of the treadle is pivotally mounted, a spreader plate 23 extending between and connecting the base plate 17 and the heel plate 21; and adjustable beater mechanism, that includes a cam shaft 25 which adjustably carries a beater stem 27 having a beater ball 29 on the outer end thereof, means for angularly positioning the beater stem 27 and foot pedal 19, and spring means 93–94 for adjusting the pedal pressure required to cause the beater ball to strike the drum head and for controlling the rebound of the beater head or ball after it has struck the drum head.

Figure 2:
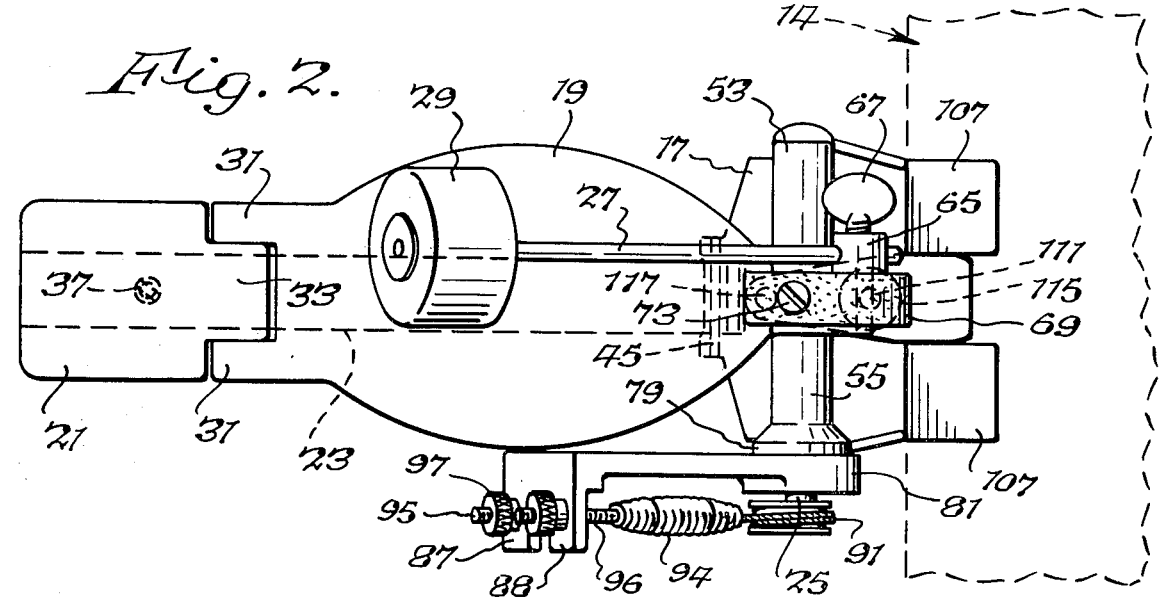
FIG. 2 is a top plan view of the drum beater illustrated in FIG. 1.

The treadle 21 at its left, lower end, as viewed in FIGS. 1 and 2, is bifurcated, the two projecting portions 31 receiving between them and being pivotally secured to a projecting, horizontal lug 33 on the heel plate 21 by a transverse pin 35 passing therethrough. The heel plate is rigidly secured to the spreader plate 23, adjacent the left end thereof, by suitable means such as a screw 37 passing through the latter into the bottom of the former. The spreader plate extends substantially horizontally to the base 17 of the beater mechanism to which it is detachably connected as best seen in FIG. 6. As there shown, the right end 39 of the spreader plate 23 is received in a recess 41 in the lower face of the base 17. Adjacent the end 39 thereof, the plate 23 is formed with a groove 43 which engages over a pin 45 that extends between and is held in horizontal lugs 47 that project from the base 17 of the beater toward the heel plate 21. Removal of the spreader plate 23 from the pin 45 requires merely lifting of the heel plate 21 and withdrawal of the plate 23 from engagement with the pin 45. Thus, the treadle 19 and base 17 are firmly held together as long as a weight, such as the foot of the drummer, rests on the treadle and heel plate, but when desired, are easily disconnected for carrying.

Extending upwardly from the base 17 and preferably integral therewith are spaced standards or posts 49 and 51 which, at their upper, free ends, are provided with horizontal, preferably integral, bearing portions 53 and 55, respectively. The latter are provided with aligned bores 56 and 57, respectively, in which the cam shaft 25 is rotatably mounted. It will be evident that, although not so shown, the bores 56 and 57 may be provided with sleeves or anti-friction elements if so esired for mounting the shaft 25.

A movable rocker cam 59, preferably having two substantially parallel vertical sides and a dumb-bell shape in vertical cross section, is provided with a horizontal bore 61 through one of its end portions by which it also is mounted on the cam shaft 25 between the bearing portions 53 and 55. The cam 59 is secured on the cam shaft for rotation therewith by suitable means, such as a set screw 63. Projecting from the outer end of the rocker cam 59 on the right side thereof, as viewed in FIG. 3, is a boss 65 having a transverse bore therethrough in which the beater stem 27 is slidably received. The stem may be held in adjusted position by a thumb screw 67 threadedly engaged in the end of the boss 65. Thus, the distance of the beater ball 29, which is secured on the outer end of the stem 27 in any suitable manner, from the beater shaft 25 may be easily varied, thereby varying also the point on the drum head at which the beater ball makes contact.

A flexible member such as a strap or belt 69 is employed to connect the foot pedal or treadle 19 with the cam shaft 25 whereby to rotate the latter. The strap 69, which may be of leather or other suitable non-elastic, flexible material, has one end suitably secured to the free end of the treadle, e.g. by a screw 71. The other end of the strap is passed around the outwardly-extending end of the rocker cam 59 and secured in suitable manner, e.g. by a screw 73, on the upper face of the cam. Thus, when the foot pedal 19 is depressed the belt or strap 69 exerts a downward pull on the outer end of the rocker cam 59 and causes rotation of the cam shaft 25 whereby the beater ball 29 is moved toward the drum head.

It is common in drum beaters to provide mechanism for resiliently resisting movement of the treadle and withdrawing the beater ball from contact with the drum head when pressure on the treadle is released. In the invention of the present application novel means for more satisfactorily accomplishing those ends is provided. Such means, broadly termed "tensioning means", comprises an adjustable arm 75 rotatably mounted by an annular collar portion 81 on a cylindrical boss 77 that extends outwardly from an enlarged end 79 of the bearing 55, concentrically of the bore 57. The collar portion 81 is held on the boss 77 in the desired adjusted position by a thumbscrew 83, the inner end of which engages in an annular, exterior groove 85 provided in the boss. The arm 75 extends outwardly from the collar portion 81 and is provided at its outer end with two fingers 87 and 88 that project outwardly, substantially normally, from the arm.

The tensioning means also comprises a camming pulley 89 suitably secured to the cam shaft 25 for rotation or oscillation therewith; flexible, relatively non-elastic means, such as a wire cable 91 secured to and passing around the pulley, said cable having two free ends; a pair of tension springs 93 and 94, each of said springs being attached by suitable means (not shown) at one end thereof to one of the free ends of said cable; and tension adjusting means for each of said springs which includes threaded stems 95 and 96 attached by suitable means (not shown) to the other ends of said springs, said stems extending through holes formed in fingers 87 and 88, respectively, and having threaded nuts 97 engaging thereon above said fingers. Preferably the stems 95 and 96 are prevented from rotation with respect to said fingers, for example by providing a flat face on each of the stems which cooperates with complementary flattened portions in the holes in the fingers or other suitable means. Also preferably, both the cable 91 and the threaded stems 95–96 are attached to the springs 93 and 94, respectively, by means that permits a swivelling action. Such means are well known.

As shown in detail in FIG. 5, the cable 91 may be secured to the camming pulley 89 by forming a loop in the cable and inserting the loop into a recess 99, formed in the periphery of the pulley, and around a removable pin 101 carried by the pulley and passing through the recess 99. As will also be seen from FIG. 5, the pulley 89 is eccentrically mounted on the cam shaft 25 and firmly secured thereon by suitable means, such as a set screw 103. It will be noted that the recess 99 is preferably provided in that portion of the periphery of the pulley 89 which is diametrically opposite the cam shaft 25 and that the diameter of the pulley that passes through the shaft 25 and recess 99 is normally substantially parallel to the arm 75, with the recess nearer the fingers 87 and 88.

As shown in FIGS. 1–3, the base 17 is adapted to be secured to a drum by clamping means. Said means comprises a pair of laterally spaced, stationary fingers 107, projecting from the lower portion of base 17 and preferably integral therewith, extending under the rim 13 of the drum 14, and a detachable, clamping finger 109 pivotally mounted above the base 17 on a stud or screw 111 secured in the base and passing through an oversize hole in the finger 109. The stud 111 is provided with a coiled compression spring 113 under the finger 109 for resiliently supporting the finger. A nut 115 is threadedly engaged on the stud 111 above the finger 109. Adjacent its inward end, the clamping finger 109 is provided with a thumb screw 117 threadedly engaged in the finger and adapted to bear against the upper surface of the base 17. It will be apparent from FIG. 1 how the fingers 107 and 109 cooperate to clamp the drum beater to the rim of a bass drum. A firm grip on the drum is assured by providing the stationary fingers 107 with inwardly beveled upper surfaces, whereby the curvature of the drum periphery is accommodated, and by providing a downwardly projecting rib 119 at the outer end of the finger 109.

In attaching the drum beater to a drum, no more than two and, in many cases, only one adjustment need be made. The clamping finger 109 pivots on the nut 115 carried by the stud 111. Thus, when the nut 115 is in proper position and the thumb screw 117 is retracted so that the finger 109 floats on the spring 113, the rim 13 of a drum can be readily inserted between the fingers 107 and 109. Then, by merely turning the screw 117 into the finger 109, the end rib 119 on the latter is caused to grip the drum rim and force it into contact with the fingers 107, thus firmly holding the drum and drum beater together.

It will be clear from the foregoing description how the described embodiment of the present invention is used. However, the operation and advantages of the several novel features may be pointed out.

After the drum beater is attached to the drum, the beater stem 27 may be adjusted in the boss 65 on the rocker cam 59 to determine the point of impact on the drum head 15 of the beater ball 29. The length of the beater stroke can be increased or decreased by changing the angular adjustment of the arm 75 and/or by adjusting the position of the rocker cam 59 on the cam shaft 25.

The novel trensioning means of the drum beater of the present invention permits unique action as the beater ball is brought toward or is retracted from the drum head. Referring to the foregoing description and to FIG. 1, it will be apparent that the double spring arrangement, with the cable 91 that connects the springs passing around the eccentrically mounted pulley 89 not only results in rapid build-up of tension in the spring 94 as the pedal 19 is depressed, so that there is a maximum of tension build-up with a minimum application of force on the pedal 19, thus providing a faster beating stroke of the beater ball 29 without a correspondingly increased effort on the pedal; but also, when pressure on the pedal is removed, the rebound of the beater ball is controlled by a building-up of tension in the spring 93. The tension in both springs 93 and 94 can be independently adjusted by the nuts 97, thus giving the user an opportunity to provide the desired response of the beater ball in both striking action and rebound action.

In the construction above described the base plate 17 is preferably of cast metal and the standards or posts 49 and 51 are preferably cast integrally therewith although the posts may be formed separately and attached to the base by suitable, known means. Also preferably, the bearing portions 53 and 55 on the posts are formed integrally with the latter. The foot pedal 19 and heel plate 21 are conveniently formed by casting although the spreader plate 23 is preferably formed of pressed metal. The cable 91 is preferably formed of flexible wire. The other elements, except for the strap 69 and beater ball 29, are also preferably constructed of suitable metal.

It will be understood that the present invention is not limited to the precise construction herein described and illustrated in the accompanying drawings. Numerous modifications and variations are possible without departing from the spirit of the invention. For example, instead of separate fingers 87 and 88 on the arm 75, they may be formed together as a single flange. Likewise, other known arrangements can be used for clamping the drum beater to a drum. It is, therefore, intended that the invention is not to be interpreted narrowly, but that it should be construed as broadly as permitted by the appended claims.

We claim:

1. A drum beater mechanism comprising: a base plate; drum clamping means carried by said base plate; a pivotally mounted treadle connected to said base plate; spaced standards mounted on said base plate, said standards mounted on said base plate, said standards extending upwardly and being provided at their upper ends with aligned bearing portions; a cam shaft rotatably mounted in said bearing portions; a rocker cam mounted on said shaft between said bearing portions for movement with said shaft; a beater stem, having a beater ball thereon, adjustably carried by said rocker cam; first flexible means connecting said treadle and said rocker cam for moving the latter to move said beater ball into contact with a drum when said treadle is depressed; tensioning means connected to said shaft for resisting rotary movement thereof, said tensioning means comprising two tension springs, each opposing the other; and a pulley carried by said cam shaft for rotation therewith, said springs being joined by second flexible means passing around said pulley.

2. A drum beater mechanism comprising: a base plate; drum clamping means carried by said base plate; a pivotally mounted treadle connected to said base plate; spaced standards mounted on said base plate, said standards extending upwardly and being provided at their upper ends with aligned bearing portions; a cam shaft rotatably mounted in said bearing portions; a rocker cam mounted on said shaft between said bearing portions for movement with said shaft; a beater stem, having a beater ball thereon, adjustably carried by said rocker cam; first flexible means connecting said treadle and said rocker cam for moving the latter to move said beater ball into contact with a drum when said treadle is depressed; and tensioning means connected to said shaft for resisting rotary movement thereof, said tensioning means comprising two tension springs, each opposing the other, supported by an arm adjustably mounted on one of said bearing portions.

3. Drum beater mechanism as defined in claim 2 wherein means is provided on said arm for adjusting the tension in said springs independently.

4. Drum beater mechanism as defined in claim 2 wherein said arm is angularly adjustable with respect to said standards.

5. Drum beater mechanism as defined in claim 4 wherein means is provided on said arm for adjusting the tension in said springs independently.

6. Drum beater mechanism as defined in claim 5 wherein a pulley is carried by said cam shaft for rotation therewith and said springs are joined by second flexible means which passes around said pulley.

7. Drum beater mechanism as defined in claim 6 wherein said pulley is circular in section and is secured eccentrically on said shaft with the portion of said pulley periphery most distant from said springs being nearest to said shaft.

8. Drum beater mechanism as defined in claim 7 wherein said second flexible means is a cable which is secured to said pulley.

9. Drum beater mechanism as defined in claim 8 wherein said treadle is pivotally mounted on a heel plate and a spreader plate detachably connects said heel plate with said base plate.

* * * * *